United States Patent [19]

Ehrenskjold et al.

[11] 3,981,613

[45] Sept. 21, 1976

[54] FOLDABLE PROPELLERS

[75] Inventors: Nils Oluf Ehrenskjold, Kolding; Torben Munk, Virum, both of Denmark

[73] Assignee: Gori-Vaerk A/S, Kolding, Denmark

[22] Filed: July 10, 1974

[21] Appl. No.: 487,220

[30] Foreign Application Priority Data

| | | |
|---|---|---|
| July 11, 1973 | United Kingdom | 33044/73 |
| Oct. 23, 1973 | United Kingdom | 49219/73 |

[52] U.S. Cl. ..... 416/142; 416/140; 416/139; 416/241 A

[51] Int. Cl.[2] ..... B63H 1/24

[58] Field of Search ..... 416/142, 131, 144, 139, 416/140, 145, 241 A, 230, 229

[56] References Cited

UNITED STATES PATENTS

| | | | |
|---|---|---|---|
| 725,097 | 4/1903 | Learnard | 416/131 X |
| 866,369 | 9/1907 | Learnard | 416/142 |
| 938,290 | 10/1909 | Thompson | 416/142 |
| 1,491,997 | 4/1924 | Messick | 416/131 |
| 1,862,481 | 6/1932 | Glenwright | 416/140 |
| 2,404,678 | 7/1946 | Wuensch | 416/145 |
| 2,532,371 | 12/1950 | Petersen | 416/142 |
| 3,038,543 | 6/1962 | Davidson | 416/241 A X |
| 3,255,826 | 6/1966 | Beck | 416/142 X |
| 3,533,714 | 10/1970 | Pfleiderer | 416/144 |
| 3,542,487 | 11/1970 | Knuth | 416/139 X |
| 3,709,634 | 1/1973 | Lorenz | 416/142 |

FOREIGN PATENTS OR APPLICATIONS

| | | | |
|---|---|---|---|
| 98,562 | 11/1924 | Austria | 416/142 |
| 768,964 | 8/1934 | France | 416/142 |
| 2,050,420 | 4/1972 | Germany | 416/142 |
| 61,987 | 2/1938 | Norway | 416/142 |
| 179,249 | 2/1966 | Australia | 416/139 |
| 4,734 | 1911 | United Kingdom | 416/131 |
| 18,344 | 1909 | United Kingdom | 416/142 |
| 179,249 | 2/1966 | U.S.S.R. | 416/139 |

*Primary Examiner*—Everette A. Powell, Jr.
*Attorney, Agent, or Firm*—Fleit & Jacobson

[57] ABSTRACT

There is disclosed a propeller adapted for driving a vehicle, such as a boat. The propeller comprises a pair of pivotally mounted propeller blades which are adapted to assume an inactive position wherein the blades are substantially aligned with the direction of vehicle movement, and a working position wherein the blades are at an angle with respect to the direction of vehicle movement. A stop means on the propeller limits the forward pivotal movement of the propeller blades to those locations between the inactive position and a stop position wherein the propeller blades each forms an oblique angle with respect to the inactive position so the propeller blades can each assume a working position which is located on either side of a perpendicular position wherein the propeller blades are perpendicularly disposed to the direction of vehicle movement.

6 Claims, 9 Drawing Figures

FOLDABLE PROPELLERS

Figure 1:
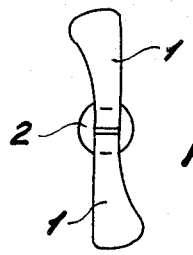

The present invention relates to propellers particularly for boats and of the kind which includes a boss secured to the end of a driving shaft, which boss is provided with one or more axially extending slots in which propeller blades are pivoted about axes at least approximately perpendicular to the axis of the shaft. Such propellers are frequently used for so-called motor sailing boats, i.e. sailing boats provided with an auxiliary motor. A conventional propeller would present a considerable resistance to the movement through the water when it is desired to sail by the wind, and for reducing this resistance propellers have been developed, therefore, in which the propeller blades are foldably hinged to the propeller shaft or boss so as to be freely pivotable between a normal, radially outwardly protruding position, in which the propeller is usable as a conventional propeller, and an inactive position in which they are folded rearwardly so as to extend almost in the direction of the propeller shaft. The blades are folded rearwardly by the water resistance when the boat moves with the motor stopped, whereby they offer a very little resistance themselves, whereas the centrifugal force will cause the blades to swing outwardly towards their active positions when the motor is started.

The folding propellers of the prior art are so constructed that the blades abut against a stop when they swing outwardly in response to the propeller being rotated for driving the boat forwardly so as to have their axes forming an angle of 90° with the propeller shaft. By their work they exert a rearward thrust on the water, and accordingly they are pressed forwardly so as to be swung out to and remain in firm engagement with the said stop, operating exactly as a conventional rigid propeller and also having, therefore, the conventional shape of the blades so as to work optimally when the blades axes are positioned at 90° relatively to the propeller shaft.

However, when the propeller is rotated for driving the boat rearwardly the efficiency of the propeller will decrease considerably due to the reaction from the water which will tend to fold together the propeller blades, and only the centrifugal force will provide an opening force on the blades. In practice the result is that the blades by rearward movement assume a position in which their axes form an angle of 50°–70° with the propeller shaft, whereby the effective propeller diameter is reduced by 15–20%. As the effective consumption is proportional to the diameter in fifth power, the propeller will hereby be able to absorb less than 30% compared with the effect which can be absorbed by forward movement. Thus, the conventional folding propellers are inefficient by rearward motor driven movement of the boat.

It is the purpose of this invention to provide a boat propeller of the folding type by which the ratio between the resultant effect of the propeller by rearward motion of the boat and the resultant effect by forward motion is much higher than by prior known propellers.

According to the invention this is obtained by a propeller wherein each of said slots extends in the direction of the shaft so far at both sides relatively to the pivot for the propeller blade that each propeller blade may adjust its own position at one or the other side of the position perpendicular to the shaft depending on the direction of rotation and on the simultaneous influence from the centrifugal force and the axial force created from the medium in which the propeller is placed.

Thus, the blades are pivotable not only from the folded position to the said 90°-position, but also beyond this latter position. Obviously, the blades will hereby not assume the said 90°-position neither by rearward nor by forward motion. Consequently, when the propeller blades are designed for maximum efficiency when the blades are swung for instance 110°–130° away from the folded position the propeller will be approximately equally effective in a position 50°–70° away from folded position during rearward motion, the shape of the blades being properly adapted to such function.

The invention further relates to a propeller blade for a propeller of the type described. In such propellers it is of importance that the blades be heavy enough to swing to their operative positions by virtue of the centrifugal force. Propeller blades for propellers for smaller ships and boats are however preferably made from a material with low specific gravity such as plastic material, and such blades will not have a weight which is sufficient for being used in foldable propellers. By use of a heavier metal as bronze such foldable propellers would be much more expensive than a normal non-foldable propeller, not only due to the special swingable arrangement of the blades, but also because of the demand of a considerable amount of after-treatment of each blade.

In order to be able to use a propeller blade of plastic material or any other light material it is therefore appropriate in accordance with the invention that the propeller blade consists of a material having a low specific gravity such as plastic material and having incorporated in the outermost part thereof a part of metal with high specific gravity so as to create a centrifugal force which, relatively to the axial force on the propeller created by the surrounding medium, is sufficient for obtaining the optimal position of the propeller blade.

Experiments have shown that for a satisfactory operation it is not necessary that the entire propeller be made of metal, since as far as the action of the centrifugal force is concerned it is less important whether the innermost portions close to the propeller shaft are heavy or not. When only a reasonable part of the outermost blade portions is made of heavy metal the center of gravity will be positioned at sufficient distance from the propeller shaft so that the blades are swung to their operative positions when the shaft starts being driven by the motor.

Figure 2A:
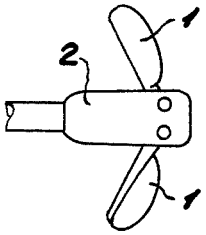
Figure 2B:
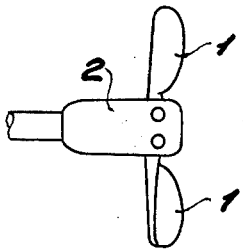
Figure 2C:
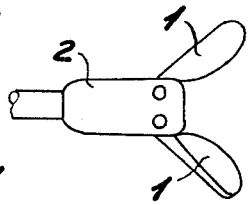
Figure 2D:
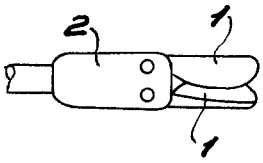

In the following the invention shall be described in more detail with reference to the accompanying drawing, in which FIG. 1 is a rear plane view of a propeller according to the invention FIG. 2*a* is a side view of the propeller blades of the invention during forward movement of the vehicle;

FIG. 2*b* is a view similar to FIG. 2*a* showing the position of the propeller blades when subjected to centrifugal force only;

FIG. 2*c* is a view similar to FIG. 2*a* showing the position of the propeller blades during rearward movement of the vehicle;

FIG. 2*d* is a view similar to FIG. 2*a* showing the propeller blades in the folded position.

Figure 3:
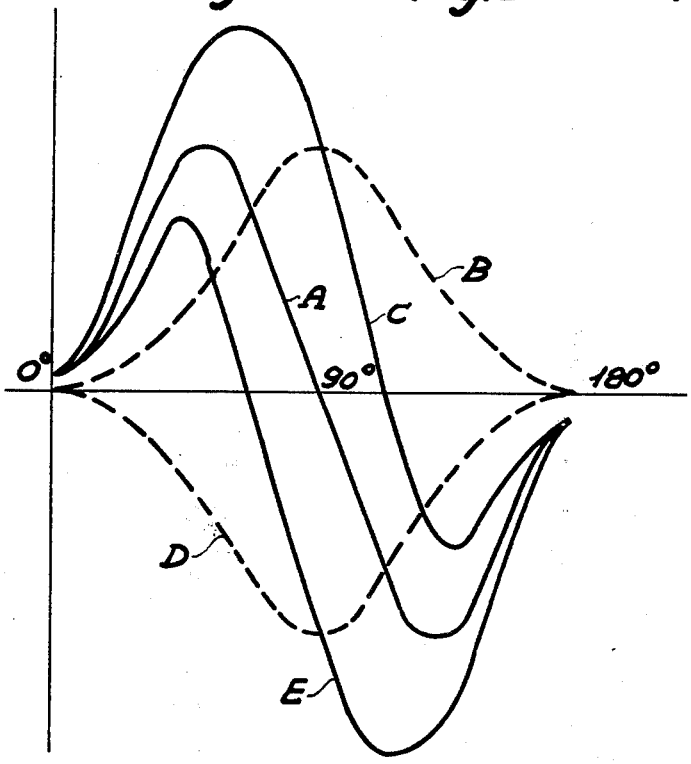
Figure 4:
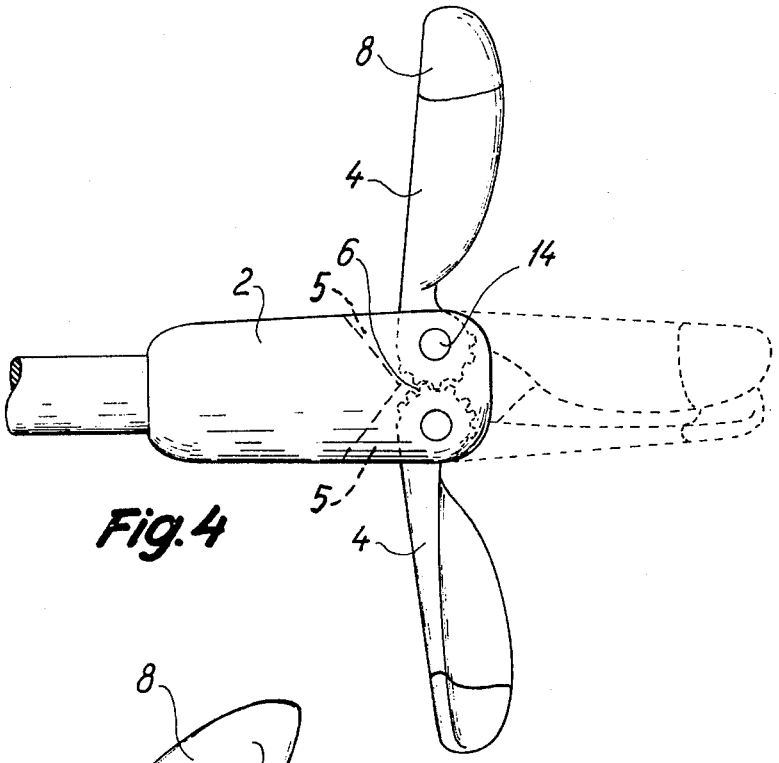
Figure 5:
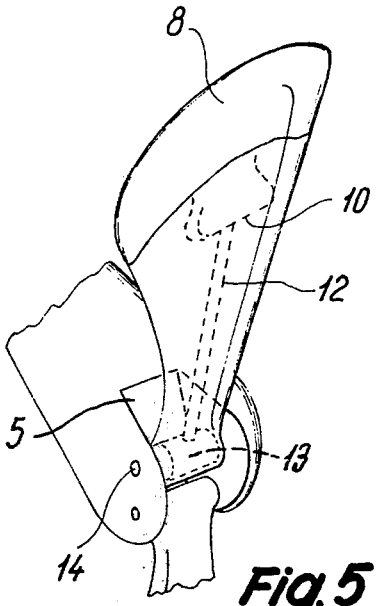
Figure 6:
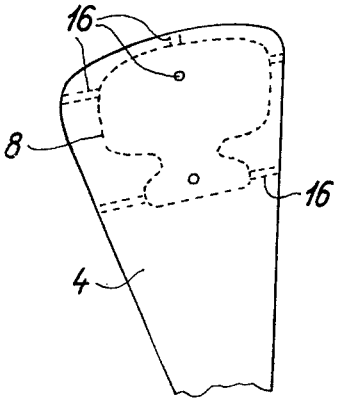

FIG. 3 is a diagram showing the moment of rotation as a function of the blade angle, i.e. the angle between the axis of the blade and the rearward direction of the propeller shaft FIG. 4 is a side elevation of a propeller according to the invention, while FIGS. 5 and 6 are front views of two different embodiments of the propeller blades.

In FIGS. 1 and 2 there is illustrated a propeller mounted on a propeller shaft and comprising a boss 2 and a number of propeller blades 1 which are pivotally secured to the boss so that they are each freely swingable in a plane through the axis of the shaft. Preferably, as known per se, the blades are interconnected by means of gear-wheel segments whereby they are bound to pivot together, though otherwise freely pivotable. FIG. 2*d* shows the position in which the blades are folded together while FIGS. 2*a–c* show different angular positions of the blades.

The curve A in FIG. 3 represents the moment of rotation tending to swing the propeller blades outwardly by the influence of the centrifugal force, shown as a function of the blade angle. At 0° the centrifugal force will be small, but sufficient to cause initial swinging out of the blades. At 90° the centrifugal force has its maximum, but the moment of rotation will be small or zero, because the force acts in the direction of the blade axis.

When the propeller rotates in water a hydrodynamic pressure will act on the blades. By forward motion this pressure will be added to the effect of the centrifugal force as long as the blades have not reached the 90° position, but from that point the hydrodynamic pressure will counteract the centrifugal force. The movement of rotation produced during forward movement by the hydrodynamic force on a propeller blade in relation to the pivot thereof is shown in a dotted curve B in FIG. 3. The force as well as the moment of rotation has its maximum when the blade angle is 90°. The resultant moment of rotation will thus be seen from the curve C, and the propeller blades will be at equilibrium where the two curves A and B are of equal magnitude but of opposite directions, at which point the curve C shows zero.

During rearward motion of the boat the hydrodynamic pressure will correspond to the dotted curve D and the resultant force is shown in curve E. It will thus be observed that the two points of equilibrium are positioned at different sides of the 90° point and consequently the propeller may preferably be constructed and designed in such a manner that the diameter and pitch thereof in the positions about 65° and 125° out of folded position are suitable for normal operations, rearwards and forwards, respectively, ensuring maximum efficiency both by forward and rearward motion of the boat.

Moreover, the advantage will be obtained that the propeller will adjust itself to a constant moment of rotation of the propeller shaft at constant speed of rotation irrespective of the actual velocity of the boat. If the velocity decreases as a result of increased movement resistance the hydrodynamic pressure on the blades will increase. By this increased pressure the blades will swing to another angular position corresponding to an increased moment of rotation acting on the blades due to the centrifugal force. In this position the effective diameter of the propeller is reduced, whereby the pressure on the blades and therewith the torque moment on the propeller shaft will decrease.

Thus, by reduced boat velocity and constant speed of rotation of the propeller the shaft torque will increase less than for a conventional screw propeller. This is an important feature for a propeller for use in connection with an internal combustion engine.

The invention is not limited to propellers for boats and ships, since the said operative advantages will be obtained for almost any kind of propeller element irrespective of the medium in which it works, and irrespective of whether the propeller belongs to a stationary or a movable part, i.e. whether it serves to drive a medium or to drive a body through the medium.

The propeller shown in FIG. 4 also shows the boss 2 in which there is pivoted two propeller blades 4 which are swingable between the operative positions shown in full lines and the inoperative positions shown in dotted lines. The innermost portions of the blades may engage each other by means of cog wheel segments 6 ensuring a simultaneous swinging of the two blades.

Each blade is pivoted on a shaft 14 in a groove or slot 5 in the boss 2, which slots in accordance with the invention are extending at both sides of the shaft 14 so as to allow each blade to swing more than 90° out from the position shown with dotted lines.

Further according to the invention the major part of the blades 4 are made from a suitable plastic material, while an outermost portion 8 of each blade is made of a heavy material such as bronze which is anchored to the plastic body in any suitable manner.

In FIG. 5 it is shown how the outer portion 8 may have a dovetail portion 10 with which it is anchored to the remaining part of the blade which is cast around the portion 10. Further the exterior portion 8 is anchored by means of a metal core 12 having its other end secured to a bushing 13 journalled on the pivot shaft 14. In FIG. 6 it is shown how the heavy body 8 may be entirely embedded in the plastic material; for properly centering the heavy body in the mould preparatory to the casting of the plastic body distance pins 16 are provided in the heavy body 8.

However, it is preferable to let at least a certain part of the exterior surface portion of the metal block 8 be exposed in order to facilitate an easy weight adjustment thereof by a subsequent balance test of the propeller.

The invention is in no way limited to the embodiments shown, since in general it comprises the use of a heavy outer portion of a foldable propeller blade of which the remaining portion is made of a lighter material.

What we claim is:

1. A propeller adapted to be fully submerged in water for a vehicle such as a boat or the like which is mounted on the aft end of the vehicle drive shaft comprising, in combination, a pair of propeller blades adapted to assume a folded position extending rearwardly of the drive shaft, means for mounting said blades at their inner ends on said shaft for freely pivotal movement into an equilibrium angular position during the forward or rearward powered movement of the vehicle throughout an angular range extending in both directions from a 90° position and in an axial plane with respect to the axis of said shaft whereby when propeller blades are designed for maximum efficiency when the blades are swung for instance 110°–130° away from the folded position for forward motion, the propeller will be approximately equally effective in a position 50°–70° away from the folded position during rearward motion, the shape of the blades being properly adapted to such function.

2. A propeller in accordance with claim 1 including stop means on said shaft for limiting the pivotal movement of said blades to a selected angular position forwardly of said 90° position.

3. A propeller in accordance with claim 1 wherein said mounting means include means for interconnecting the inner ends of said blades for simultaneous pivotal movement of said blades in the same direction and into the same angular position with respect to the axis of said shaft.

4. A propeller in accordance with claim 2 wherein said mounting means includes a boss on the aft end of said shaft having a diametral slot and including means for pivotally mounting the inner ends of said blades on said boss within said slot and wherein said stop means comprise a bottom wall in said slot for limiting the forward pivotal movement of said blades at an obtuse angle with respect to the axis of said shaft.

5. A propeller in accordance with claim 1 wherein said blades are freely pivotal into said folded position extending rearwardly of the aft end of said shaft when moving forward without power.

6. A propeller in accordance with claim 1 wherein the outermost position of each of said blades includes a material of a heavier composition than the remaining portion of said blade so as to create a centrifugal force which, relative to the axial force on the propeller created by the water, is sufficient for obtaining the optimal position of the blades.

* * * * *